US005127376A

United States Patent [19]

Lynch

[11] Patent Number: 5,127,376

[45] Date of Patent: Jul. 7, 1992

[54] ROTARY VALVE SHAFT

[76] Inventor: Robert M. Lynch, 14732 Palmer, Posen, Ill. 60469

[21] Appl. No.: 696,317

[22] Filed: Apr. 30, 1991

Related U.S. Application Data

[63] Continuation of Ser. No. 591,817, Oct. 2, 1990, abandoned.

[51] Int. Cl.[5] ..... F01L 7/02

[52] U.S. Cl. ..... 123/190.2; 123/190.4; 123/190.6

[58] Field of Search ..... 123/190 A, 80 BA, 190 B, 123/190 BB, 190 BD

[56] References Cited

U.S. PATENT DOCUMENTS

| | | | |
|---|---|---|---|
| 1,702,816 | 2/1929 | Danford | 123/190 A |
| 1,860,725 | 5/1932 | Stoner | 123/190 BA |
| 2,730,088 | 1/1956 | Hyde | 123/190 A |
| 4,134,381 | 1/1979 | Little | 123/80 BA |
| 4,517,938 | 5/1985 | Kruger | 123/190 E |
| 4,541,371 | 9/1985 | Kageyama et al. | 123/190 A |

OTHER PUBLICATIONS

Article entitled: "Say Smokey: what's the car engine of the future?" appearing in Mar. 1989 issue of *Popular Science* magazine.

*Primary Examiner*—E. Rollins Cross
*Assistant Examiner*—Erick Solis
*Attorney, Agent, or Firm*—Laff, Whitesel, Conte & Saret

[57] ABSTRACT

A novel rotary valve system is provided which comprises an intake rotary valve shaft and an exhaust rotary valve shaft, each shaft including a passage adapted to deliver fuel to the combustion chamber or remove exhaust gas from the combustion chamber. Each passage comprises a groove having a U-shaped cross-section extending around the periphery of the shaft and a rectangular notch communicating with the groove on one side of the notch. The novel fuel and exhaust passage of this embodiment may instead be incorporated in a single rotary valve shaft. In another embodiment, two rotary valve shafts are provided having an intake and exhaust passage, each passage including a 360° groove and valve channels extending through the rotary valve shafts and communicating with the grooves.

13 Claims, 2 Drawing Sheets

ROTARY VALVE SHAFT

This application is a continuation of application Ser. No. 07/591,817, filed Oct. 2, 1990, now abandoned.

FIELD OF THE INVENTION

This invention relates to internal combustion engines and, more specifically, to a novel rotary valve system to be used in an internal combustion invention.

BACKGROUND OF THE INVENTION

It was heretofore known to use rotary valves with internal combustion engines. The rotary valves may be located in the cylinder head and, through the use of internal passages, open and close ports in the cylinder head to alternately deliver fuel to the combustion chamber for combustion and allow exhaust to escape from the combustion chamber after the combustion.

Rotary valves eliminate the need for all of the parts used in conventional valve trains and, thus, can be easier to manufacture and install. In addition, valves used in the conventional valve trains have a reciprocating motion, which is a drawback in high speed operation. This drawback is eliminated by the use of rotary valves. Additionally, a longstanding problem associated with internal combustion engines, regardless of the type of valve employed, is inefficient distribution of fuel to the combustion chamber and removal of exhaust from the combustion chamber.

An object of this invention is to improve upon internal combustion systems by providing an improved rotary valve system having a novel gas passage design comprising a groove extending around the periphery of the rotary valve shaft, which provides a more efficient flow of intake and exhaust gasses through the valving.

In accordance with this and other objectives, a rotary valve system for an internal combustion engine is provided which comprises a novel rotary valve having a means for the passage of fuel gas into and exhaust gas out of the combustion chamber. The passage means comprises the groove extending 360° around the periphery of a shaft.

In a first embodiment, the passage means also comprises a notch, which communicates with the groove and which, by rotation of the rotary valve shaft, is adapted to align with one of the ports of the combustion chamber. This embodiment may comprise either a single shaft comprising both the intake and exhaust fuel passage means or two shafts with one of them comprising the intake fuel passage means and the other comprising the exhaust fuel passage means. With either version of this first embodiment, one of the notches is adapted to align with the intake port and one of the notches is adapted to align with the exhaust port.

In another embodiment, the fuel passage means also comprises a valve channel which extends through the rotary valve and which communicates with the groove. In the preferred version of this embodiment, the channel extends at an angle from the bottom of the groove to the periphery of the shaft. Preferably, there is an intake rotary valve shaft and an exhaust rotary valve shaft. The channels of the rotary valve shafts, by rotation of those shafts, are adapted to align with either the intake or exhaust port of the combustion chamber.

The foregoing invention, and its advantages, may be more readily appreciated from the following detailed description of a preferred embodiment, when read in conjunction with the following drawings:

DETAILED DESCRIPTION OF THE INVENTION

Figure 1:
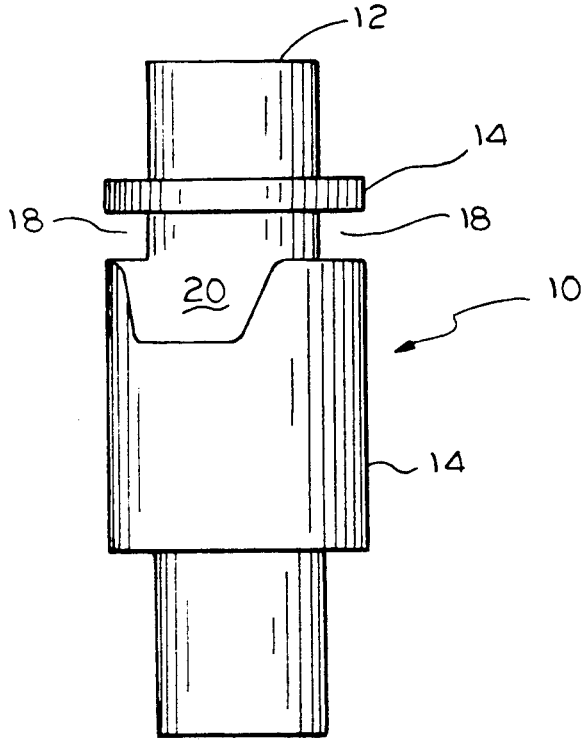
FIG. 1 is a top elevational view of one of the rotary valve shafts in accordance with a version of the first embodiment of the invention having a single fuel passage means.

A novel rotary valve 10 in accordance with a first embodiment of the invention is shown in FIG. 1. The valve 10 comprises a shaft 12 formed with a collar 14. Formed within collar 14 is at least one fuel passage means comprising a groove 18 extending 360° around the periphery of the shaft, and a notch communicating with the groove. Preferably, the notch is generally rectangular and has edges leading into groove 18 which are rounded to allow fuel gas to pass through the notch more rapidly. The cross-section of groove 18 may be U-shaped.

Figure 3:
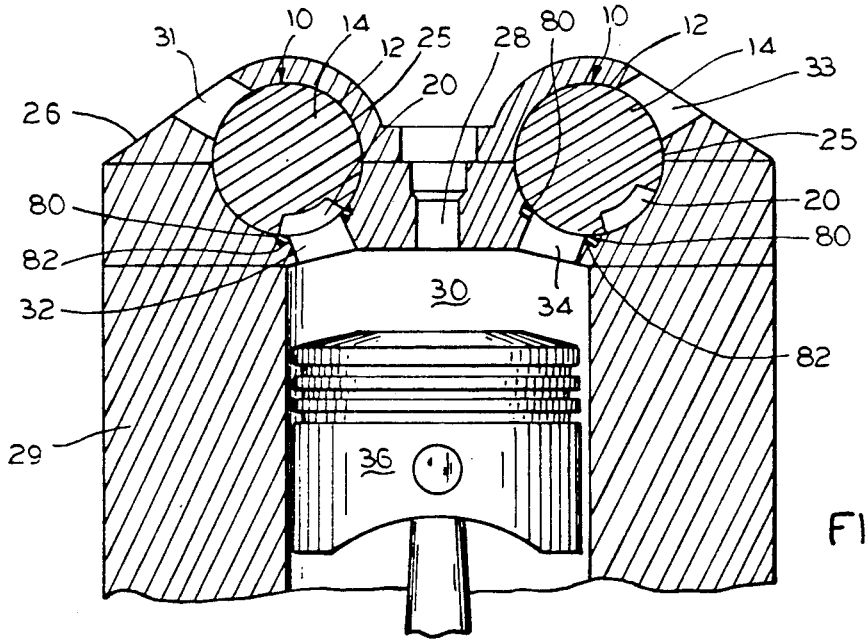
FIG. 3 is a front sectional view of a cylinder head incorporating two rotary valves of the type shown in FIG. 1.
Figure 4:
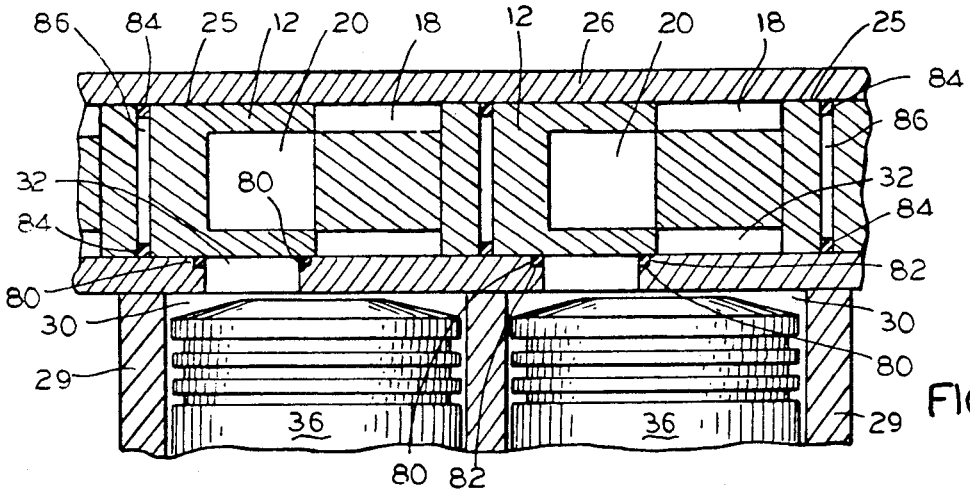
FIG. 4 is a partial side sectional view of a multi-cylinder engine incorporating a rotary valve shaft having a plurality of fuel passage means.

In accordance with this embodiment, two rotary valves 10 are rotatably mounted through respective bores 25 of a cylinder head as shown in FIG. 3 or in any other suitable manner. One of the rotary valves serves as a fuel intake passage means and the other as an exhaust passage means. The cylinder head 26 also has a spark plug hole 28 which extends into a combustion chamber 30 located in a cylinder block 29. An intake port 32 and an exhaust port 34 are also formed within the cylinder head 26 to allow fuel gas to pass into and exhaust gas to pass out of the combustion chamber 30. A conventional piston 36 is located within the combustion chamber 30. An intake runner 31 supplies fuel to the intake rotary valve and an exhaust runner 33 allows exhaust gas to escape the exhaust rotary valve. The rotary valves 10 may be constructed from any suitable material, including conventional metals. The number of fuel passage means on each shaft 12 may vary depending on the number of combustion chambers and engine design. For example, FIG. 4 shows in partial a single shaft comprising two fuel passage means.

In operation, the intake port 32 and exhaust port 34 remain closed by collars 14 through most of the rotation of the rotary valves 10. When the piston 36 is in its intake stroke, however, notch 20 of the intake rotary valve aligns with intake port 32, allowing fuel to pass from an intake runner 31 through groove 18 and intake port 3 into the combustion chamber 30 for combustion. Thereafter, as both valves continue to rotate, intake port 32 and exhaust port 34 are closed by collars 14, and the piston conducts its compression and power strokes. The continuing rotation of the valves then causes notch 20 of the exhaust rotary valve 10 to align with exhaust port 34, allowing the exhaust gas to escape through notch 20 of the exhaust rotary valve. This combustion cycle is repeated continuously.

Figure 2:
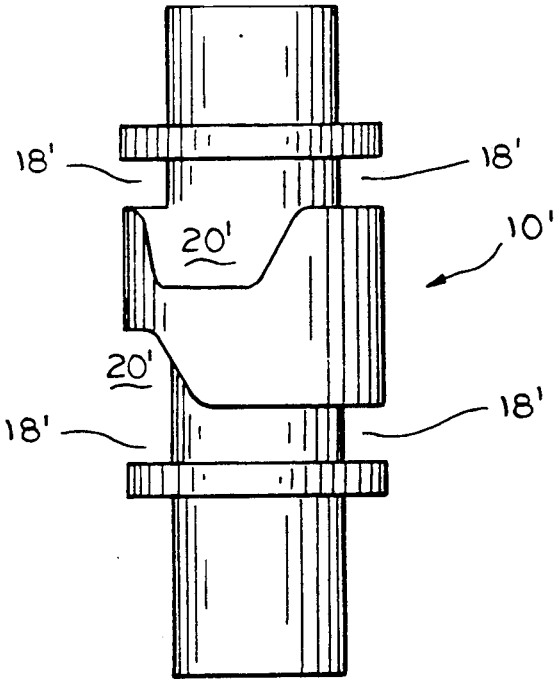
FIG. 2 is a top elevational view of a single rotary valve shaft in accordance with a version of the first embodiment of the invention having two fuel passage means.

The rotary valve system described above may instead comprise the single rotary valve 10' of FIG. 2 in accordance with another version of this embodiment of this invention. The single rotary valve 10' of FIG. 2 incorporates at least one intake passage means and at least one exhaust passage means two fuel passage means, thus eliminating the need for two rotary valves. Each fuel passage means comprises a groove 18' and a notch 20' which communicate in the manner discussed above in connection with the first embodiment. In accordance with this second embodiment, the rotary valve 10' is rotatably mounted through a single bore of a cylinder head in any suitable manner. The cylinder head also houses a spark plug hole which extends into a combustion chamber having an intake port and an exhaust port. The single rotary valve operates to deliver fuel and remove exhaust gasses in the identical manner as the rotary valve of FIGS. 1, 3 and 4, except that the rotation of the single valve accomplishes both the delivery of fuel and removal of the exhaust gasses. The number of intake and exhaust fuel means on each shaft may vary depending on the number of combustion chambers and engine design.

Figure 5:
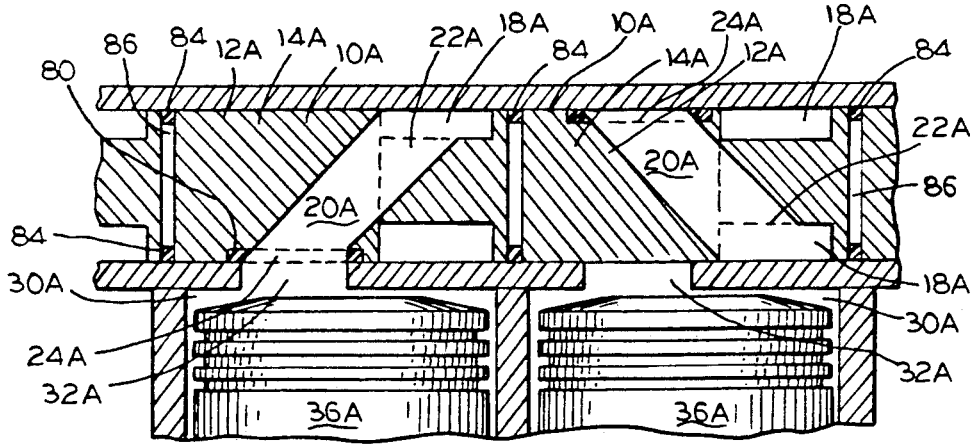
FIG. 5 is a partial side sectional view of a multi-cylinder engine showing a rotary valve shaft in accordance with a second embodiment of the invention incorporated into the multi-cylinder engine.

A rotary valve system in accordance with a second embodiment of the invention is shown in FIG. 5 incorporated into a multi-cylinder engine. In this embodiment, two rotary valves 10A are provided, each of which comprises a shaft 12A and a collar 14A. Formed within each collar 14A is a fuel passage means comprising a groove 18A extending 360° around the periphery of the shaft and a valve channel 20A extending through the rotary valve shaft. The valve channel 20A has a first opening 22A, which communicates with groove 18A, and a second opening 24A, which, by rotation of the rotary valve shaft, is adapted to align with either an intake port 32A or an exhaust port (not shown) of a combustion chamber 30A. In order to be able to connect groove 18A to the port, valve channel 20A may extend at an angle which is skewed relative to the longitudinal axis of the rotary valve shaft. The number of fuel passage means on each shaft 12A may vary depending on the number of combustion chambers and engine design. The rotary valves 10A are installed in a manner similar to the manner in which the rotary valves of the first embodiment are installed.

The second embodiment of the invention operates in a manner similar to the first embodiment, except that the fuel or exhaust gasses enter or exit the combustion chamber 30A through the valve channel 20A. More specifically, during the intake stroke of a piston 36A, the rotation of the rotary valves 10A allows the valve channel 20A of the intake rotary valve to align with the intake port 32A, allowing fuel to pass from an intake runner through groove 18A and valve channel 20A into combustion chamber 30A for combustion. The continued rotation of the rotary valves then cause collars 14A to close both ports so that combustion can occur. Thereafter, the valve channel of the exhaust valve aligns with the exhaust port, allowing exhaust to escape from the combustion chamber 30A through the valve channel 20A, groove 18A and an exhaust runner. This combustion cycle is repeated continuously.

Proper sealing is, of course, required with any embodiment and may be accomplished in any manner. One suggested sealing construction includes port seals 80 as shown in FIGS. 3-5. The port seal 80 consists of a circular metal seal placed within a seal area 82, which can be machined into the cylinder head 26 around the ports. Seals 84 shown in FIGS. 4 and 5 which fit within seal grooves 86 also may be included. The seals 84 may be conventional piston seals.

Each of the ends of the rotary valve shafts of either of the embodiments may be mounted to the cylinder heads through the use of conventional bearings or bushings, and the rotation of the valve shafts may be accomplished in any desired manner. Proper lubrication is, of course, necessary and may be accomplished in any conventional manner. The bearings or bushings can be sealed from the shaft with, for instance, a conventional lip seal.

As with conventional valve systems, there are many design variables which may be chosen to affect the performance of the engine including, for example, the valve open duration and the valve open overlap. With this invention, the design variables include the dimensions of the ports, notches, valve bores and grooves, each of which may be adjusted to achieve the desired performance.

The above embodiments of this invention may be used with the multi-cylinder engine having a plurality of combustion chambers. As stated, the number of rotary valve shafts may depend upon the number of cylinders and the engine design. For example, an engine having aligned cylinders would require less rotary valve shafts than an engine having opposed cylinders.

The foregoing description is for the purposes of illustration only, and does not limit the scope of protection which should be accorded this invention. The latter is to be measured by the following claims, which should be interpreted as broadly as the invention permits.

I claim:

1. A rotary valve shaft for use with an internal combustion engine having a combustion chamber port, the rotary valve shaft including at least one gas passage means comprising a groove on the periphery of the rotary valve shaft and a means for connecting the groove with said port upon rotation of the rotary valve shaft, wherein the connecting means comprises a notch adjacent to and leading into the groove.

2. The rotary valve shaft of claim 1 wherein the notch is generally rectangular in shape and comprises a pair of rounded edges leading into the groove.

3. The rotary valve shaft of claim 1 wherein there are two of said gas passage means, one for delivery of fuel gas to the combustion chamber and one for the removal of exhaust gas from the combustion chamber.

4. A rotary valve system for an internal combustion engine having a combustion chamber, a combustion chamber intake port and a combustion chamber exhaust port, the rotary valve system comprising a rotary valve shaft comprising a fuel passage means and an exhaust passage means, each of said passage means comprising a groove extending around the periphery of the shaft and a notch communicating with the groove, the rotary valve shaft being adapted to deliver fuel gas through the fuel passage means to the combustion chamber through the intake port and being adapted to allow exhaust gas to escape the combustion chamber through the exhaust port.

5. The rotary valve system of claim 4 wherein the rotary valve shaft further comprises a collar, both of said passage means being formed within the collar.

6. The rotary valve system of claim 4 wherein the notch of the fuel passage means is adapted by rotation of the rotary valve shaft to align with the intake port and wherein the notch of the exhaust passage means is adapted by rotation of the rotary valve shaft to align with the exhaust port.

7. The rotary valve system of claim 6 wherein the notches are generally rectangular in shape and comprise curved leading edges leading into the grooves to allow fuel and exhaust gasses to pass through the notches more rapidly and wherein the cross-section of each of said grooves is U-shaped.

8. The rotary valve system of claim 6 wherein the rotary valve system further comprises a cylinder head having a bore, the rotary valve shaft being positioned within the bore; and means for rotating the rotary valve shaft in synchronism with the engine.

9. The rotary valve system of claim 8 wherein the internal combustion engine is a multi-cylinder engine having a plurality of combustion chambers and wherein the rotary valve system comprises a plurality of rotary valve shafts.

10. A rotary valve system for an internal combustion engine having a combustion chamber, a combustion chamber intake port and a combustion chamber exhaust port, the rotary valve system comprising a first rotary valve shaft adapted to deliver fuel gas to the combustion chamber through the intake port;

the first rotary valve shaft including a fuel passage means, the fuel passage means comprising a first groove extending around the periphery of the first rotary valve shaft and a means for connecting the first groove with the intake port upon rotation of the first rotary valve shaft;

a second rotary valve shaft adapted to allow exhaust gas to escape the combustion chamber through the exhaust port; and the second rotary valve shaft including an exhaust passage means, the exhaust passage means comprising a second groove extending around the periphery of the second rotary valve shaft and a means for connecting the second groove with the exhaust port upon rotation of the second rotary valve shaft;

wherein the first groove connecting means comprises a first notch communicating with the first groove, the first notch being adapted to align with the combustion chamber intake port upon rotation of the first rotary valve to allow fuel gas to enter the combustion chamber, and wherein the second groove connecting means further comprises a second notch communicating with the second groove, the second notch being adapted to align with the combustion chamber exhaust port upon rotation of the second rotary valve to allow exhaust gas to escape the combustion chamber.

11. The rotary valve system of claim 10 wherein the first rotary valve further comprises a first collar, the fuel passage means being formed within the first collar, and wherein the second rotary valve means further comprises a second collar, the exhaust passage means being formed within the second collar.

12. The rotary valve shaft system of claim 11 wherein the first notch is located adjacent the first groove and wherein the second notch is located adjacent the second groove.

13. The rotary valve system of claim 12 wherein the first and second notches are generally rectangular in shape and comprise a pair of rounded edges leading into the first and second grooves to allow the fuel and exhaust gasses to pass through the notches more rapidly.

* * * * *